US009373250B2

(12) United States Patent
Dizechi et al.

(10) Patent No.: US 9,373,250 B2
(45) Date of Patent: Jun. 21, 2016

(54) REMOTE CONTROLLER HAVING ONE SHOT AUTOMATIC MAPPING OF LEARNED FUNCTION

(71) Applicant: SMK ELECTRONICS CORPORATION, Chula Vista, CA (US)

(72) Inventors: Manuchehr Dizechi, San Diego, CA (US); Shashidhar Krishnamurthy, Chula Vista, CA (US)

(73) Assignee: SMK ELECTRONICS CORPORATION, Chula Vista, CA (US)

( * ) Notice: Subject to any disclaimer, the term of this patent is extended or adjusted under 35 U.S.C. 154(b) by 9 days.

(21) Appl. No.: 14/585,678

(22) Filed: Dec. 30, 2014

(65) Prior Publication Data

US 2015/0371530 A1 Dec. 24, 2015

(51) Int. Cl.
*G08C 19/16* (2006.01)
*G08C 17/02* (2006.01)
*G08C 23/04* (2006.01)

(52) U.S. Cl.
CPC ..... *G08C 17/02* (2013.01); *G08C 23/04* (2013.01); *G08C 2201/20* (2013.01)

(58) Field of Classification Search
CPC ..... G08C 17/02; G08C 23/04; G08C 2201/20
See application file for complete search history.

(56) References Cited

U.S. PATENT DOCUMENTS 8,786,411 B1 * 7/2014 Seidel ..... G11B 27/005 340/12.23
9,071,329 B2 * 6/2015 Escobosa ..... G06F 8/65
2002/0130803 A1 * 9/2002 Conway ..... G08C 17/02 341/176
2003/0046579 A1 * 3/2003 Hayes ..... H04N 7/163 726/27
2004/0054826 A1 * 3/2004 Kavanagh ..... A63F 13/10 710/62
2004/0075642 A1 * 4/2004 Kisliakov ..... G06F 1/1626 345/156
2006/0164932 A1 * 7/2006 Kavanagh ..... G11B 19/025 369/30.28
2006/0244625 A1 * 11/2006 Verdickt ..... G08C 17/00 340/4.3
2011/0114716 A1 * 5/2011 Pratt ..... H04L 12/2814 235/375
2013/0176117 A1 * 7/2013 Lee ..... G08C 19/26 340/12.17

* cited by examiner

*Primary Examiner* — Erin File
(74) *Attorney, Agent, or Firm* — Westerman, Hattori, Daniels & Adrian, LLP

(57) ABSTRACT

A learning remote controller for learning functions received from a source controller. The learning remote controller includes a memory and a processor that executes a program stored in the memory. The program controls operations of the processor select and retrieve a device map corresponding to a source remote controller having functions that are to be learned by the learning remote controller, the device map establishing a correspondence between a key pressed on the source remote controller and a key on the learning remote controller to which a function received from the source remote controller is to be mapped. When a code corresponding to a function received from the source remote controller, corresponds to a first signal received from the source remote controller, the code is stored for comparison with subsequent codes received by the learning remote controller. Upon comparison with subsequent codes received, the processor inserts a code corresponding to no function in a sequence of learned codes in response to the comparison of the received code and the stored code being a match.

3 Claims, 14 Drawing Sheets

400

| Key press sequence on the SOURCE remote during the learning process | TV Device MAP | DVR/VCR Device MAP | AUDIO/RCVR Device MAP | STB/CBL Device MAP |
|---|---|---|---|---|
| 1 (FIRST Key) | PWR (FIRST Key) | PWR (FIRST Key) | PWR (FIRST Key) | PWR (FIRST Key) |
| 2 | Mute | Play | Mute | Mute |
| 3 | Volume Up | Pause | Volume Up | Volume Up |
| 4 | Volume Down | Record | Volume Down | Volume Down |
| 5 | Channel Up | Stop | Surround R | Channel Up |
| 6 | Channel Down | FWD | Surround L | Channel Down |
| 7 | Arrow Up▲ | RWD | - | Arrow Up |
| 8 | Arrow Down ▼ | Menu | - | Arrow Down |
| 9 | Arrow Left ◀ | Arrow Up | - | Arrow Left |
| 10 | Arrow Right ▶ | Arrow Down | - | Arrow Right |
| 11 | OK | Arrow Left | - | OK |
| 12 | 0 | Arrow Right | - | 0 |
| 13 | 1 | OK | - | 1 |
| 14 | 2 | - | - | 2 |
| 15 | 3 | - | - | 3 |
| 16 | 4 | - | - | 4 |
| 17 | 5 | - | - | 5 |
| 18 | 6 | - | - | 6 |
| 19 | 7 | - | - | 7 |
| 20 | 8 | - | - | 8 |
| 21 | 9 | - | - | 9 |
| 22 | * | - | - | * |
| 23 | # | - | - | # |
| 24 | Back | - | - | Back |
| 25 | Menu/Cancel | - | - | Guide |
| 26 | Input | - | - | Input |
| 402 | 404 | 406 | 408 | 410 |

FIG. 4

DEVICE TAG

| | |
|---|---|
| TV | 0x01 |
| DVD | 0x02 |
| AUDIO | 0x03 |
| STB/CBL | 0x04 |

KEY TAG

| KEY COUNT (Also used as KEY TAG) | Key press sequence on the SOURCE/ORIGINAL remote during the learning process | 404 TV Device MAP | 406 DVD/VCR Device MAP | 408 AUDIO/RCVR Device MAP | 410 STB/CBL Device MAP |
|---|---|---|---|---|---|
| 0x01 | 1 (FIRST Key) | PWR (FIRST Key) | PWR (FIRST Key) | PWR (FIRST Key) | PWR (FIRST Key) |
| 0x02 | 2 | Mute | Play | Mute | Mute |
| 0x03 | 3 | Volume Up | Pause | Volume Up | Volume Up |
| 0x04 | 4 | Volume Down | Record | Volume Down | Volume Down |
| 0x05 | 5 | Channel Up | Stop | Surround R | Channel Up |
| 0x06 | 6 | Channel Down | FWD | Surround L | Channel Down |
| 0x07 | 7 | Arrow Up ▲ | RWD | - | Arrow Up |
| 0x08 | 8 | Arrow Down ▼ | Menu | - | Arrow Down |
| 0x09 | 9 | Arrow Left ◀ | Arrow Up | - | Arrow Left |
| 0x0A | 10 | Arrow Right ▶ | Arrow Down | - | Arrow Right |
| 0x0B | 11 | OK | Arrow Left | - | OK |
| 0x0C | 12 | 0 | Arrow Right | - | 0 |
| 0x0D | 13 | 1 | OK | - | 1 |
| 0x0E | 14 | 2 | - | - | 2 |
| 0x0F | 15 | 3 | - | - | 3 |
| 0x10 | 16 | 4 | - | - | 4 |
| 0x11 | 17 | 5 | - | - | 5 |
| 0x12 | 18 | 6 | - | - | 6 |
| 0x13 | 19 | 7 | - | - | 7 |
| 0x14 | 20 | 8 | - | - | 8 |
| 0x15 | 21 | 9 | - | - | 9 |
| 0x16 | 22 | * | - | - | * |
| 0x17 | 23 | # | - | - | # |
| 0x18 | 24 | Back | - | - | Back |
| 0x19 | 25 | Menu/Cancel | - | - | Guide |
| 0x1A | 26 | Input | - | - | Input |

FIG. 9

| 402 | 404 | 700 |
|---|---|---|
| Key press sequence on the SOURCE remote during the learning process | TV Device MAP | TV |
| 1 | PWR (FIRST Key) | PWR |
| 2 | Mute | Mute |
| 3 | Volume Up | Volume Up |
| 4 | Volume Down | Volume Down |
| 5 | Channel Up | Channel Up |
| 6 | Channel Down | Channel Down |
| 7 | Arrow Up ▲ | PWR (Hole) |
| 8 | Arrow Down ▼ | PWR (Hole) |
| 9 | Arrow Left ◀ | PWR (Hole) |
| 10 | Arrow Right ▶ | PWR (Hole) |
| 11 | OK | PWR (Hole) |
| 12 | 0 | 0 |
| 13 | 1 | 1 |
| 14 | 2 | 2 |
| 15 | 3 | 3 |
| 16 | 4 | 4 |
| 17 | 5 | 5 |
| 18 | 6 | 6 |
| 19 | 7 | 7 |
| 20 | 8 | 8 |
| 21 | 9 | 9 |
| 22 | * | * |
| 23 | # | # |
| 24 | Back | PWR (Hole) |
| 25 | Menu/Cancel | Menu/Cancel |
| 26 | Input | Input |

FIG. 12

| 402 | 800 |
|---|---|
| Key press sequence on the SOURCE remote during the learning process | DVD |
| 1 | PWR |
| 2 | Play |
| 3 | Pause |
| 4 | PWR (Hole) |
| 5 | Stop |
| 6 | FWD |
| 7 | RWD |
| 8 | Menu |
| 9 | Arrow Up |
| 10 | Arrow Down |
| 11 | Arrow Left |
| 12 | Arrow Right |
| 13 | OK |
| 14 | - |
| 15 | - |
| 16 | - |
| 17 | - |
| 18 | - |
| 19 | - |
| 20 | - |
| 21 | - |
| 22 | - |
| 23 | - |
| 24 | - |
| 25 | - |
| 26 | - |

FIG. 13

REMOTE CONTROLLER HAVING ONE SHOT AUTOMATIC MAPPING OF LEARNED FUNCTION

TECHNICAL FIELD

The present invention relates to a learning remote controller having a learning function that enables the learning remote controller to learn functions from a source remote controller. More specifically, the present invention relates to a learning remote controller that is capable of learning, mapping, storing and reproducing a set of remote control functions faster and with reduced user intervention during the learning process.

BACKGROUND OF THE INVENTION

Remote controllers that are capable of learning a function from another remote controller are known. Conventionally, the process of learning a function from another remote controller typically requires a source remote controller and a learning remote controller. The source remote controller is one that outputs a function. The learning remote controller receives and learns the function output from the source remote controller.

The typical learning method involves placing the source remote controller and the learning remote controller face to face so that the learning remote controller can receive a signal from the source remote controller. The learning remote controller is then placed in the learning mode. After the learning remote controller is placed in the learning mode, a key on the learning remote controller is selected and pressed. The selected key on the learning remote controller corresponds to a key to which a function received from the source remote controller will be mapped. A key on the source remote controller is then selected and pressed. The selected key on the source remote controller corresponds to a function that will be mapped to the selected key on the learning remote controller, and when the key on the source remote controller is pressed a signal corresponding to the function of the selected key on the source remote controller is transmitted to the learning remote controller. The learning remote controller maps the received function corresponding to the selected key on the source remote controller to the selected key on the learning remote controller.

The abovementioned steps of pressing a selected key on the learning remote controller and pressing a selected key on the source remote controller to map a function of the source remote controller to a key of the learning remote controller are repeated until all intended keys are learned, and saved in memory. After all intended keys are learned, a confirmation key is pressed and the learning mode is exited.

In the conventional learning remote controller, the user must select and press a key on the learning remote controller for each and every function received from the source remote controller to be mapped to the learning remote controller.

SUMMARY OF THE INVENTION

It is an aspect of the embodiments discussed herein to provide a learning remote controller and learning method wherein an operator does not have to select a button on the learning remote controller for each and every function received from the source remote controller to be mapped to the learning remote controller. Instead, in accordance with aspects of the embodiments, a control code corresponding to a function of the source remote controller to be learned by the learning remote controller is automatically mapped to a particular key on the learning remote controller based on a device map selectable by the operator.

In accordance with aspects of the embodiments, less work on the part of the operator is required in terms of mapping the functions of the source remote controller to the learning remote controller. The device maps ensure that the function sequence is known and fixed for each device category. The learning process is less time consuming and less prone to human error.

BRIEF DESCRIPTION OF THE DRAWINGS

The aspects and advantages of the invention will become apparent in the following description taken in conjunction with the drawings, wherein:

FIG. 4 is a diagram illustrating an exemplary device map in accordance with embodiments of the present invention;

FIG. 9 is a diagram illustrating respective device tags associated with each device and respective key tags associated with keys in the device maps for the respective devices;

FIG. 12 is a diagram illustrating an example of a learning sequence for the learning remote controller 100 when learning the functions of TV source remote controller where certain keys and their associated functions are not available on the TV source remote controller; and FIG. 13 is a diagram illustrating an example of a learning sequence for the learning remote controller 100 when learning the functions of DVD source remote controller where a certain key and its associated function is not available on the DVD source remote controller.

DETAILED DESCRIPTION OF THE INVENTION

Figure 1:
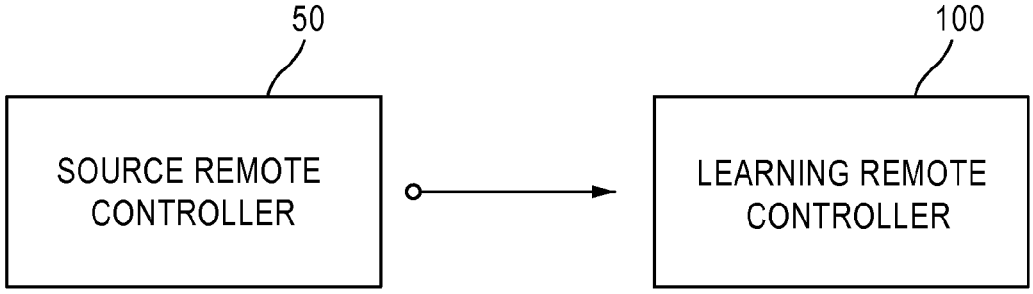
FIG. 1 illustrates an overview of an exemplary system for one shot automatic mapping of learned functions in accordance with embodiments of the present invention.

Reference will now be made in detail to preferred embodiments of the present invention, examples of which are illustrated in the accompanying drawings, wherein like reference numerals refer to like elements throughout.

FIG. 1 illustrates an overview of an exemplary system for one shot automatic mapping of learned functions according to embodiments the present invention. As shown in FIG. 1, the system includes a source remote controller 50 and a learning remote controller 100.

The source remote controller 50 may be any type of remote controller that permits a user to enter commands that are transmitted to a controlled device by, for example, infrared (IR) signals, radio frequency (RF) or other wireless signals. The source remote controller 50 stores control codes that correspond to functions performed by the controlled device. These control codes may be read out of the memory, decoded, and transmitted to the controlled device as, for example, IR signals.

As will be described in more detail hereinafter, when the learning remote controller 100 is placed in a learning mode, the learning remote controller 100 can learn functions from the source remote controller 50 thereby duplicating the functionality of the source remote controller 50. During the learning mode, the source remote controller 50 and the learning remote controller 100 are preferably placed face-to-face as shown in FIG. 1, and the learning remote controller 100 receives from the source remote controller 50 the signals corresponding to the functions of source remote controller 50. The learning remote controller 100 analyzes the signals received from the source remote controller, maps the function to a particular key of the learning remote controller 100, stores and ultimately reproduces the functions of the source remote controller 50.

It should be understood that the system shown in FIG. 1 is exemplary, and that other embodiments and modifications are possible. For example, although system of FIG. 1 is described with respect to a source remote controller 50 and a learning remote controller 100, the source remote controller 50 may more generally be considered any source device capable of transmitting codes associated with control functions to be received and learned by the learning remote controller 100. Furthermore, the learning remote controller 100 may more generally be considered to be any device that incorporates the hardware and functionality of the learning remote controller 100 described herein, such as a smart phone.

Figure 2:
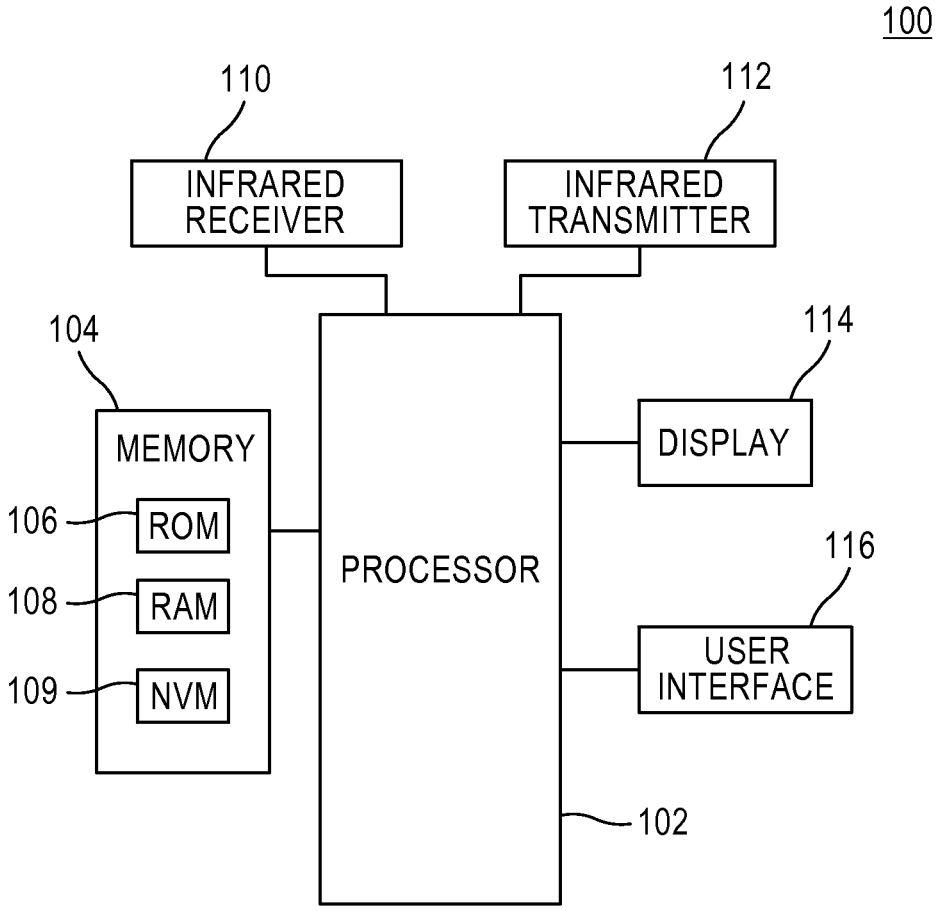
FIG. 2 illustrates a block diagram of various components of an exemplary learning remote controller in accordance with embodiments of the present invention.

FIG. 2 is a block diagram illustrating an exemplary hardware configuration of the learning remote controller 100. As illustrated in FIG. 2, the learning remote controller 100 includes a processor 102, a memory 104, an infrared receiver 110, an infrared transmitter 112, a display 114 and a user interface 116. The learning remote controller may also include an IR decoder (not shown).

The infrared receiver 110 receives, filters and amplifies infrared signals from the source remote controller 50, and may be any of a variety of well-known types of circuits that can receive, filter and amplify infrared signals. The signals are further processed by the processor 102 to decode the timing and characteristics (carrier, envelop, repeat) information of the incoming signal. Of course, infrared signals are merely exemplary and the invention is not limited to infrared signals. For example, the infrared receiver 110 may be replaced with a receiver for other types of wireless signals, such as radio frequency (RF) signals.

The infrared transmitter 112 transmits pulses of infrared light that represent control codes corresponding to commands, including the learned commands. The infrared transmitter 112 may be any of a variety of well-known types of circuits that can generate infrared light representing control codes for controlling a controlled device. Of course, an infrared transmitter is merely exemplary, and the invention is not limited to transmitting infrared signals. For example, the infrared transmitter 112 may be replaced with a transmitter for other types of wireless signals, such as radio frequency (RF) signals.

The memory 104 may include read only memory (ROM) 106, random access memory (RAM) 108 and non-volatile memory (NVM) 109 capable of read/write operation, such as EEPROM, FLASH, and NVRAM. The non-volatile memory 109 stores therein in separate memory locations data used for executing the various functions of the learning remote controller 100, such as a device map (described hereinafter), and data learned by the learning remote controller 100. The non-volatile memory 109 may also store information such as the current device state and current device mode. The memory 104 stores various programs that execute the various functions of the learning remote controller 100. The programs that execute the various functions of the learning remote controller 100 may be stored in the ROM 106, RAM 108 or NVM 109.

The display 114 is an output interface, and may include light emitting diodes (LEDs) or a liquid crystal display (LCD) that displays various kinds of information, including characters and images, to provide the user a visual indication of information. In addition to the display 114, an audio input/output unit may be provided as an input-output interface that inputs sound through a microphone and outputs sound through a speaker.

The user interface 116 is may be a keyboard, key matrix or other suitable interface for user input.

The processor 102 is a central processing unit (CPU) that executes the various programs stored in the memory 104 to control the infrared receiver 110, the infrared transmitter 112, the display 114 and the user interface 116, described above. The processor 102 also executes a program to control the learning of control codes or commands received from the source remote controller 50, as will be described hereinafter.

The source remote controller 50 may have a general hardware configuration that is similar to the hardware configuration of the learning remote controller 100 shown in FIG. 2. The source remote controller 50 may be any of well-known types of remote controllers, such as a remote controller that controls a television, a remote controller that controls audio, a remote controller that controls a DVD player, a remote controller to control cable, a remote controller to control satellite, etc.

Next, the learning processing performed by the learning remote controller 100 will be described below with reference to the flow chart diagram shown in FIGS. 3 and 3A, which illustrates an exemplary process by which the learning remote controller 100 learns functions from the source remote controller 50. It will be understood that each of the steps performed in the flow chart shown in FIG. 3 can be implemented by computer program instructions that are stored in the memory 104 and are provided to and executed by the processor 102 to implement the functions specified in the flow chart.

Initially, prior to the start of learning, source remote controller 50 and the learning remote controller 100 are placed to face each other, in the manner shown in FIG. 1, such that the learning remote controller 100 can receive command codes from the source remote controller 50. The learning remote controller 100 is then placed in the learning mode (step 300). The learning remote controller 100 may be placed in the learning mode in a variety of ways. For example, a dedicated key on the user interface 116 may be pressed for a predetermined amount of time (e.g., 3 seconds) and released upon receiving an indication that the learning mode has been set. The indication that the learning mode is set may be, for example, a blinking LED on the display 114.

After the learning remote controller 100 is placed in the learning mode, a device map is selected by pressing an appropriate key on the learning remote controller 100 (step 302). Alternatively, the device map may also be selected by the use of the LCD screen or the TV on-screen display. The device map is stored in the processor 102 or in the memory 104 of the learning remote controller 100, and may be in the form of a list or table of key functions supported and the sequence in which the user is expected to press the keys on the source remote controller 50 during the learning process. The key functions supported are dependent on the device map list, which in turn is dependent on the number of buttons or keys on the remote controller and also the user requirement decision prior to implementation.

FIG. 4 illustrates an example of a device map 400 in accordance with embodiments of the present invention. As indicated hereinabove, the device map 400 is stored in the non-volatile memory 109. As shown in FIG. 4, the left hand column 402 of the device map 400 lists a sequence 1 through 26, which provides an order in which function keys on respective source remote controllers 50 are to be pressed during the learning process. Columns 404, 406, 408 and 410 of the device map 400 provide device maps for different source remote controllers 50 and list key functions corresponding to the order listed in the column 402 for the respective different source remote controllers 50. Specifically, column 404 provides a device map for a source TV remote controller and lists key functions of the TV remote controller that are to be learned by the learning remote controller 100. Column 406 provides a device map for a source DVD/VCR remote controller and lists key functions of the DVD/VCR remote controller that are to be learned by the learning remote controller 100. Column 408 provides a device map for a source AUDIO/RCVR remote controller and lists key functions of the AUDIO/RCVR remote controller that are to be learned by the learning remote controller 100. Column 410 provides a device map for a source STB/CBL remote controller and lists key functions of the STB/CBL remote controller that are to be learned by the learning remote controller 100.

By way of example, as shown in FIG. 4, the column 404 in conjunction with the ordering listed in column 402 provides a TV Device Map establishing an order in which function keys on a source remote controller 50 for a TV are to be pressed during the learning process. According to the TV Device Map shown in column 404, the power (PWR) key on the source remote controller 50 is to be pressed first during the learning process, the Mute key is to be pressed second during the learning process, the Volume Up key is to be pressed third during the learning process, the Volume Down key is to be pressed fourth during the learning process, and so on, according the ordering established in the column 402 of the device map table 400. Each of the device maps shown in columns 404, 406, 408 and 410 in FIG. 4 similarly establish an order in which keys on a source remote controller 50 are pressed during the learning process. As can be seen in column 402 in the device map table in FIG. 4, the key press sequence on the source remote controller 50 includes a sequence for twenty-six keys 1-26. Although the device map in FIG. 4 illustrates a key press sequence of twenty-six keys, and the embodiments describe a key press sequence of twenty-six keys 1-26, this is exemplary. The device map 400 and the embodiments described are not limited to a key press sequence of twenty-six keys, and the number of keys in the key press sequence may be more or less than twenty six.

Figure 5:
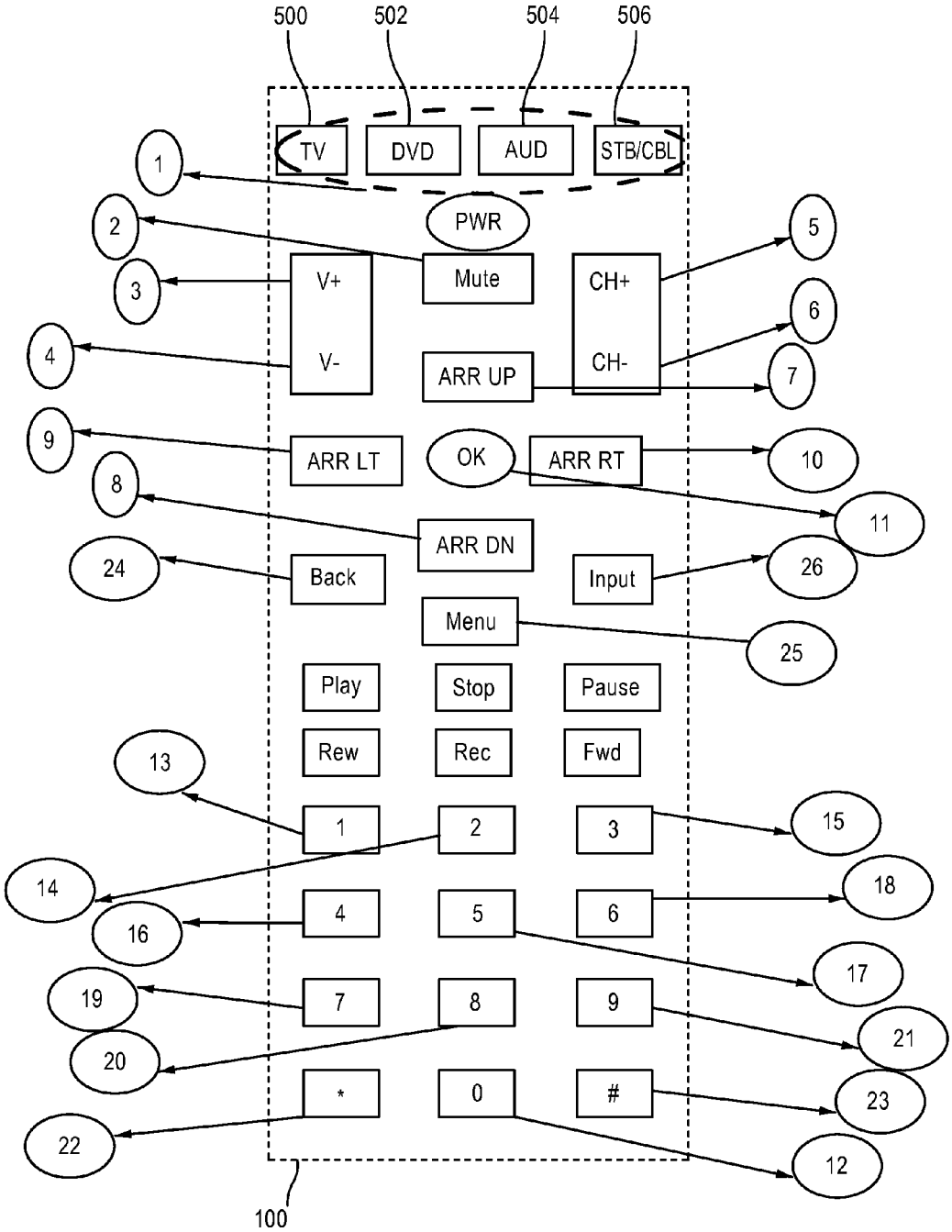
FIG. 5 is a diagram illustrating an example of a key layout for a learning remote controller and mapping when a TV device map is selected in accordance with embodiments of the present invention.

FIG. 5 shows an example of a key layout for a learning remote controller 100 and mapping when the TV device map 404 is selected. The device map selection keys are shown at the top of the learning remote controller 100 and include a key 500 for selecting the TV device map 404, a key 502 for selecting the DVD/VCR device map 406, a key 504 for selecting the AUDIO/RCVR device map 408, and a key 506 for selecting a STB/CBL device map 410. As shown in FIG. 5, when the TV device map 404 is selected, the first key pressed on the source TV remote controller is mapped to the power (PWR) key on the learning remote controller 100, the second key pressed on the source TV remote controller is mapped to the Mute key on the learning remote controller 100, the third key pressed on the source TV remote controller is mapped to the Volume Up key on the learning remote controller 100, and so on until all twenty-six keys on the TV source remote controller are mapped to keys on the learning remote controller 100.

Figure 6:
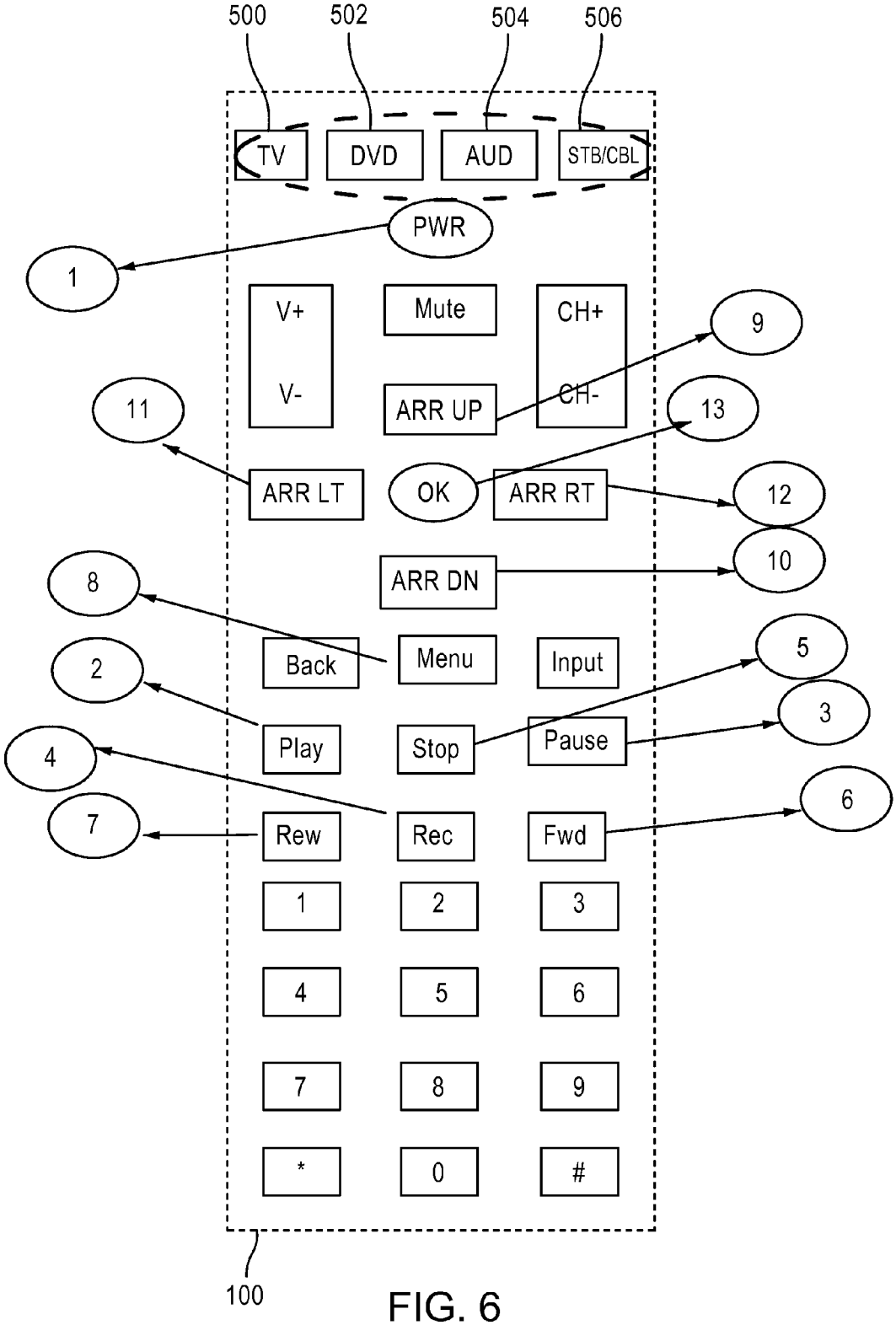
FIG. 6 a diagram illustrating an example of a key layout for a learning remote controller and mapping when a DVR/VCR device map is selected in accordance with embodiments of the present invention.

FIG. 6 shows an example of a key layout for a learning remote controller 100 and mapping when the DVD/VCR device map 406 is selected. As shown in FIG. 6, when the DVD/VCR device map 406 is selected, the first key pressed on the source DVD/VCR remote controller is mapped to the power (PWR) key on the learning remote controller 100, the second key pressed on the source DVD/VCR remote controller is mapped to the Play key on the learning remote controller 100, the third key pressed on the source DVD/VCR remote controller is mapped to the Pause key on the learning remote controller 100, and so on until all keys on the DVD/VCR source remote controller are mapped to keys on the learning remote controller 100.

It will be recognized that in the case that the learning remote controller 100 has fewer physical keys than the source remote controller 50, then the keys on the learning remote controller 100 can be double assigned to behave a separate keys in different modes. For example, in the case of the learning remote controller 100 missing physical keys to perform the DVD functions, the digit keys 1 though 6 can be assigned to Play, Pause, Stop, Rewind, Forward and Record keys, respectively, in the DVD mode.

Figure 3:
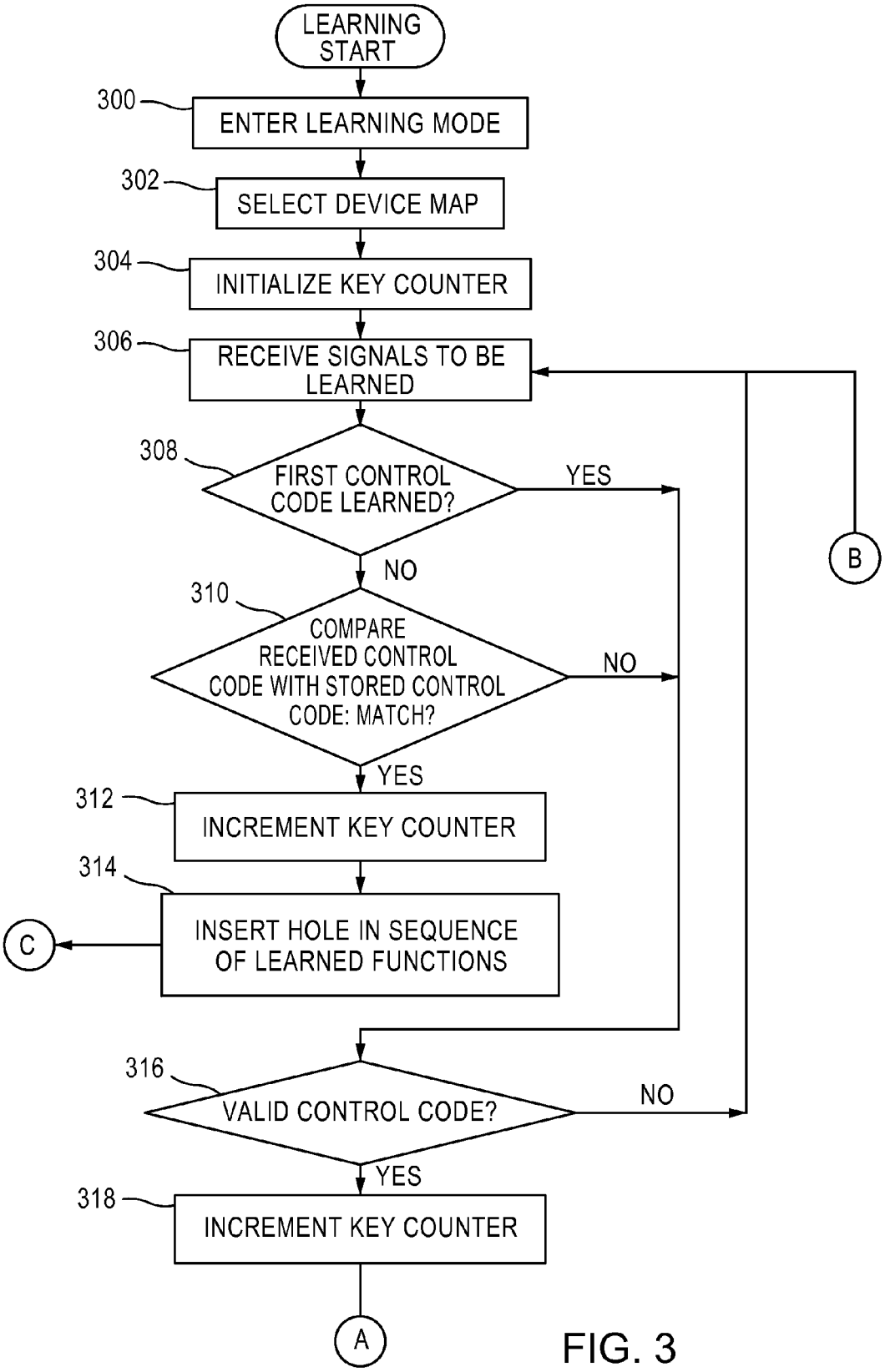
FIGS. 3 and 3A are a flow chart diagram illustrating an exemplary process by which the learning remote controller learns functions from a source remote controller in accordance with embodiments of the present invention.
Figure 3A:
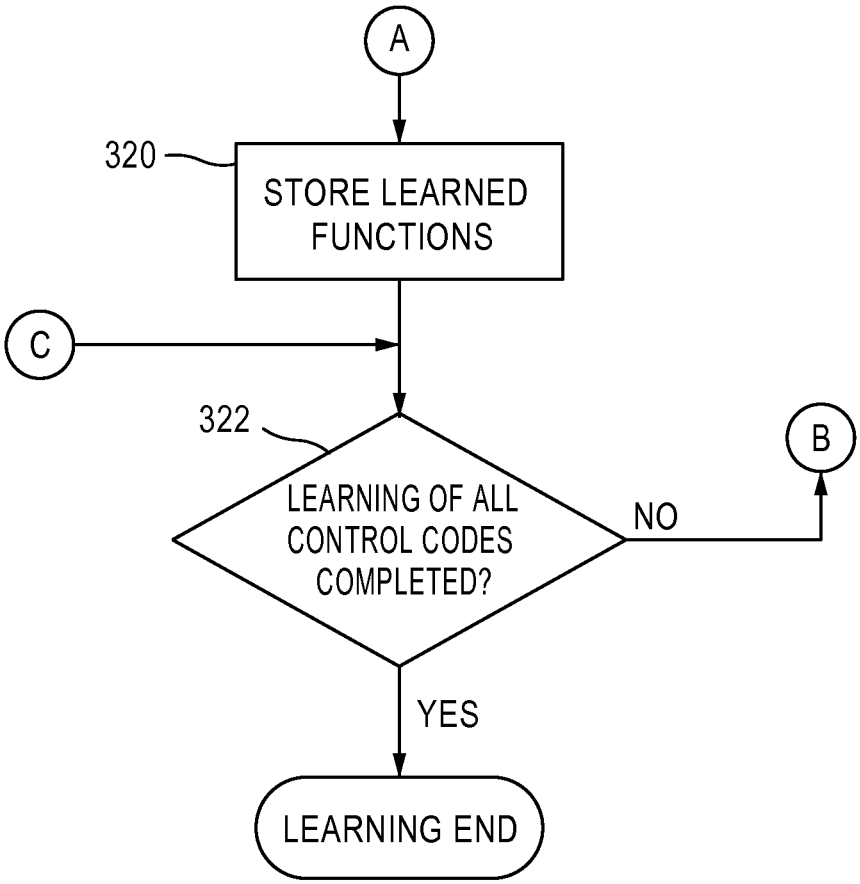

Referring back to the flow chart of FIG. 3, after the device map 400 has been selected in step 302, next, in step 304, a key counter is initialized. The counter permits the learning remote controller 100 to keep count of the keys in the learning sequence to assign the control codes received from the source remote controller 50 to the appropriate keys on the learning remote controller 100. Next, in step 306, the learning remote controller 100 receives an IR signal from the source remote controller 50 corresponding to a control code generated by the user pressing a key on the source remote controller 50 in the order specified by the device map selected for the particular source remote controller 50. For example, the signals received by the learning remote controller 100 are generated by the user pressing keys on the source remote controller 50 in the order specified by the selected device map. The device map information is provided to the user in the form of a manual or pad prints or inserts or labels, or in the form of display, such as an LCD or other type of display. Alternatively, a combination of the aforementioned means may be used to provide device map information to the user. The IR signal received by the learning remote controller 100 is then converted to a control code (i.e., a digital signal) corresponding to the function of the key pressed on the source remote controller 50, and this control code may be processed by the processor 102.

When a key defined in the selected device map is missing from the source remote controller 50 or is not supported by the source remote controller 50, the user is expected to press on the source remote controller 50 the first key defined in the device map. As shown in FIG. 4, the first key defined in each of the device maps 404-410 is the power (PWR) key. Of course, the first key defined in the device maps 404-410 may be a key different from the power (PWR) key.

In step 308, it is determined whether the signal received by the learning remote controller 100 corresponds to the first control code being learned by the learning remote controller 100. It is determined whether the signal received by the learning remote controller 100 corresponds to the first control code being learned in the following manner. The location of a first control code corresponding to the first signal is reserved in the memory 104 with a unique marking data by default. The marking data is overwritten upon first valid storage of a control code, irrespective of the pattern. When a control code is received from the source remote controller 50 for learning, if the marking data is intact, then it is considered to be the first control code. The first control code being learned corresponds to the first key defined by the key press sequence for the selected device map 400. For example, as shown in FIG. 4, for each device map 404, 406, 408 and 410, the first key defined in the key press sequence on the source remote controller 10 is the power (PWR) key.

If it is determined in step 308 that the control code received by the learning remote controller 100 corresponds to the first control code being learned (YES, in step 308), then the process proceeds to step 316 where it is determined whether the control code is a valid learnable control code. It may be determined whether the control code is a valid learnable control code based on basic signal characteristics like carrier frequency, number of unique timing values, repeat patterns, duration of the inter-signal gap, and will be used in combination to determine the validity of the signal in case of an IR signal. Similarly, appropriate characteristics are to be used in the case of non-IR signals. If it is determined in step 316 that the signal is not a valid learnable control code, the process returns to step 306.

In the case that the determination in step 316 is affirmative (YES, in step 316), then in step 318, the key counter is incremented. Next, in step 320, the control code corresponding to the first signal being learned that was received in step 306 is converted into a suitable format by the processor 102 and is stored in memory for the selected device map. The storing, or mapping, of the control code in memory for the selected device map may be performed in several different ways, which will be described hereinafter.

After the learned function is stored in memory in step 320, it is determined in step 322 whether all control codes have been successfully learned. For example, the TV device map includes 26 keys. The learning remote controller 100 keeps count of the keys in the learning sequence by the key counter to appropriately assign the appropriate control codes to the appropriate keys on the learning remote controller 100.

If it is determined in step 308 that the control code received by the learning remote controller 100 does not correspond to the first control code being learned (NO in step 308), then the process proceeds to step 310 where the control code received in step 306 is compared to the stored control code corresponding to the function of the first learned key. As described hereinabove, the control code corresponding to the function of the first learned key was previously stored in the memory 109 in response to receiving the signal corresponding to the first key pressed on the learning remote controller 50.

If the comparison in step 310 determines that the currently received control code does not correspond to the stored control code corresponding to the first key pressed on the source remote controller 50 (NO in step 308), then the process proceeds to step 316 where it is determined whether the received control code is a valid learnable control code. In the case that the determination in step 316 is affirmative (YES in step 316), the control code corresponding to the function of the key on the source remote controller 50 currently being learned, which was received in step 306, is converted in step 320 into a suitable format by the processor 102 and is stored in memory for the selected device map.

However, if the comparison in step 310 determines that the received control code corresponds to the stored control code corresponding to the first key pressed on the learning remote controller 50 (YES in step 310), then it has been determined that key defined in the selected device map is missing from the source remote controller 50 or is not supported by the source remote controller 50. The process then proceeds to step 312, where the key counter is incremented. Next, the process proceeds to step 314 where a "hole" is designated in the sequence of learned keys and their corresponding control codes stored in memory. The "hole" indicates no function, and, for example, may be hexadecimal FFFF. In accordance with an exemplary embodiment, the learning remote controller 100 determines that the "hole" is to be designated in the sequence of learned keys when the control code received from the source remote controller 50 by the learning remote controller 100 is not the control code corresponding to the first key signal received from the source remote 50 and corresponds to the control code of the power key (PWR). However, the present invention is not limited to using the power key (PWR) function to recognize that a "hole" should be designated, and an alternate key function may be used for recognizing that a "hole" is to be designated.

After the "hole" is designated in the sequence of control codes corresponding to learned keys in step 314, the process determines whether the learning of all control codes and corresponding functions is completed in step 322. If the learning of all control codes is not completed, then steps 306 through 322 are repeated until all control codes are learned. If the learning of all control codes is completed, then the learning process ends.

After the learning of all control codes is complete, the learned codes are saved in the memory 104 in an order that may be sequential/fixed location/random with indication to the user by means of LED blink or other suitable means. The learned codes can either be stored as raw timing values or can be encoded for better management of signals and memory.

The storing, or mapping, of the control code received from the source remote controller 50 in memory, as performed in step 320, for the selected device map may be performed in several different ways. For example, one way of mapping is to partition the memory 104, in accordance with the device maps, into fixed memory blocks, respectively corresponding to the TV device map, the DVD/VCR device map, the AUDIO/RCVR device map and the STB/CBL device map, and to store the learned functions in respective fixed blocks. The fixed memory blocks include storage assigned for each of the keys.

The learning remote controller 100 will store the control code from the source remote controller 50 in the non-volatile memory 109. The location at which the control code is stored can be pre-defined. The location at which the control code is stored can be decided dynamically at the time of storage. The control code can be stored in random sequence with in a defined location boundary and identified with the help of a tag (in-line with the device map) for retrieval.

Figure 7:
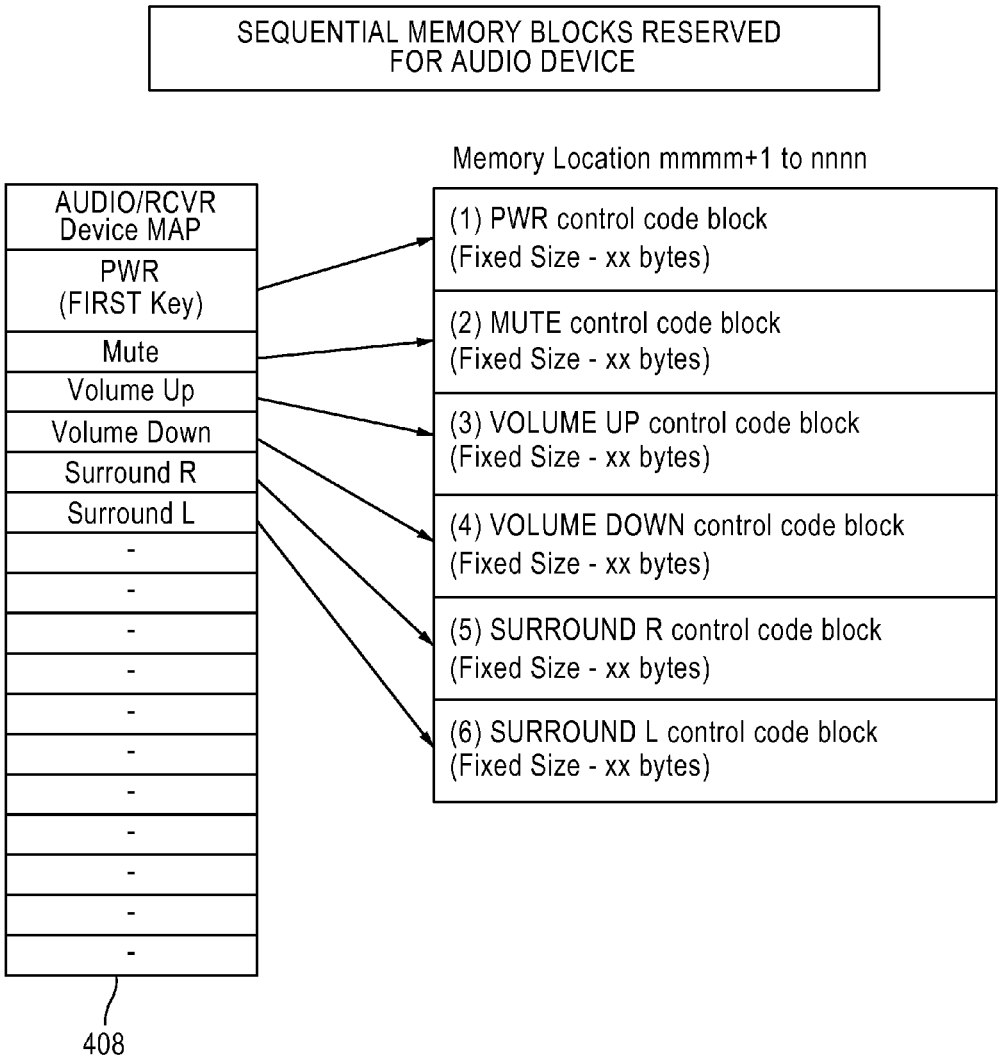
FIG. 7 is a diagram illustrating an example where the memory is partitioned into sequential fixed size memory blocks respectively corresponding to an AUDIO/RCVR device map, and control codes received from the source remote controller are stored sequentially in the fixed size memory blocks.

FIG. 7 is a diagram illustrating an example where the memory 104 is partitioned into sequential fixed size memory blocks respectively corresponding to the AUDIO/RCVR device map 408, and control codes received from the source remote controller 50 are stored sequentially in the fixed size memory blocks. As shown in FIG. 7, a fixed size block of memory is assigned to the PWR key for storing the control code received from the source remote controller 50 corresponding to the PWR key. A fixed size block of memory is assigned to the MUTE key for storing the control code received from the source remote controller 50 corresponding to the MUTE key. A fixed sized block of memory is assigned to the VOLUME UP key for storing the control code received from the source remote 50 corresponding to the VOLUME UP key, and so on for all the keys in the AUDIO/RCVR device map 408.

Figure 8:
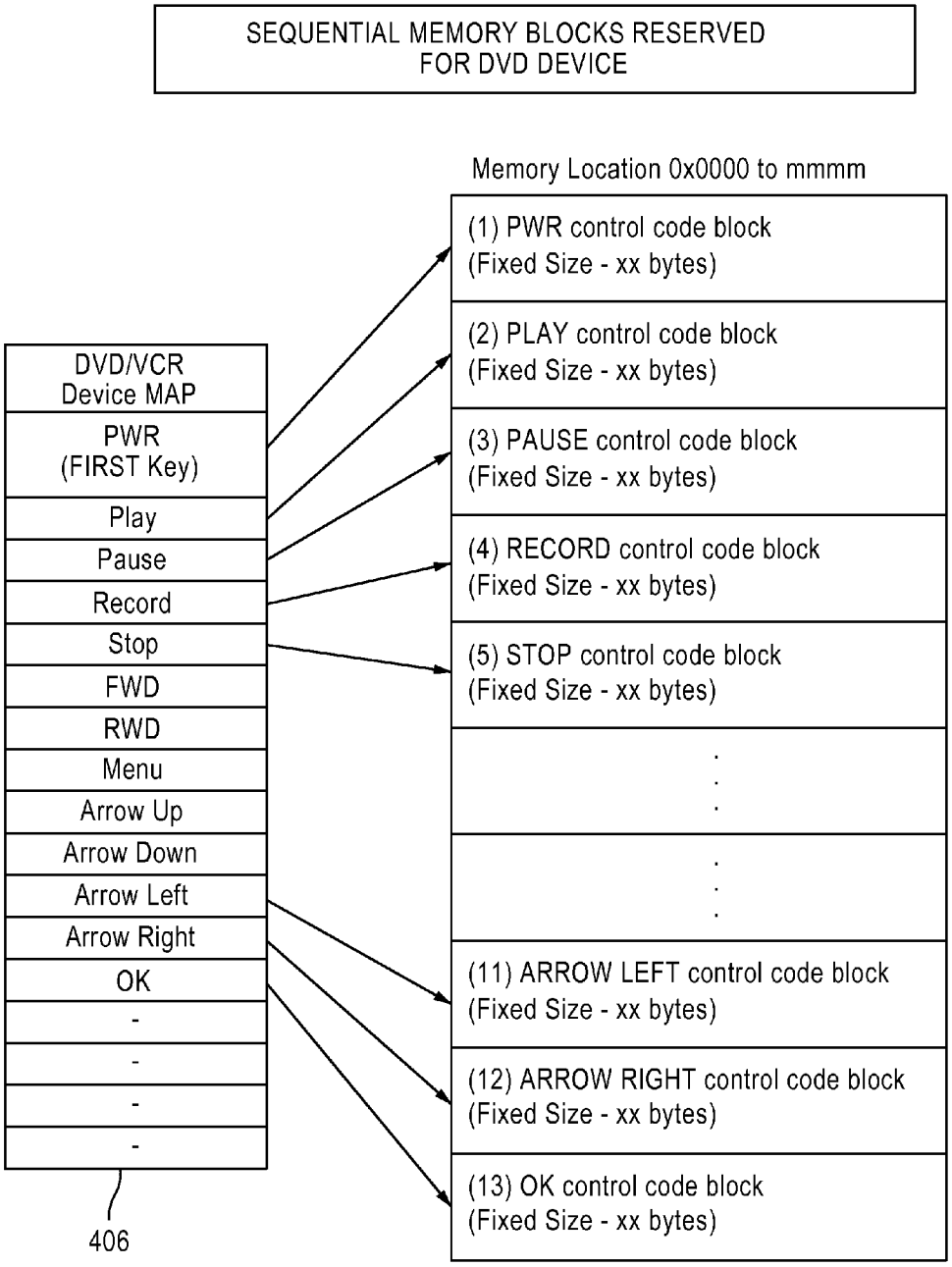
FIG. 8 is a diagram illustrating an example where the memory is partitioned into sequential fixed size memory blocks respectively corresponding to a DVD/VCR device map, and control codes received from the source remote controller are stored sequentially in the fixed size memory blocks.

FIG. 8 is a diagram illustrating an example where the memory 104 is partitioned into sequential fixed size memory blocks respectively corresponding to the DVD/VCR device map 406, and control codes received from the source remote controller 50 are stored sequentially in the fixed size memory blocks. As shown in FIG. 8, a fixed size block of memory is assigned to the PWR key for storing the control code received from the source remote controller 50 corresponding to the PWR key. A fixed size block of memory is assigned to the PLAY key for storing the control code received from the source remote 50 corresponding to the PLAY key. A fixed size block of memory is assigned to the PAUSE key for storing the control code received from the source remote 50 corresponding to the PAUSE key, and so on for all the keys in the DVD/VCR device map 406. An example of the storage process shown in FIG. 8 will be described below.

By way of example, the storage of the control code received from the source remote controller 50 and corresponding to the PWR key in a fixed size block of memory corresponding to the DVD/VCR device map 406 is performed in the following manner.

DVD/VCR "PWR" key association:

Initial address for DVD/VCR, for example, 0x1000

Key counter value is (1)

Size allocated of control code, for example, 100 bytes (0x64)

Start address: 0x1000+0x64*(1−1)=0x1000

The PWR control code received from the source remote controller 50 is stored within the address range 0x1000 to 0x1063 (0x1000+(0x64−1)).

By way of example, the storage of the control code received from the source remote controller 50 corresponding to the PLAY key in a fixed size block of memory corresponding to the DVD/VCR device map 406 is performed in the following manner.

DVD/VCR "PLAY" key association:

Initial address for DVD/VCR, for example, 0x1000

Key counter value is (2)

Size allocated of control code, for example, 100 bytes (0x64)

Start address: 0x1000+0x64*(2−1)=0x1064

The PLAY control code received from the source remote controller 50 is stored within the address range 0x1064 to 0x10C8 (0x1064+0x64). The remaining control codes received from the source remote controller 50 corresponding to the DVD/VCR device map 406 are stored similarly.

The process described above for storing control codes with respect to the DVD/VCR device map 406 also applies to the TV device map 404, the AUDIO/RCVR device map 408, and the STB/CBL device map 410.

An example of a process of retrieval of the control codes stored in the manner described above with respect to FIGS. 7 and 8 will be described below. The process of retrieval of the control codes is performed by the processor 102.

For example, when the DVD/VCR device mode has been selected on the learning remote controller 100 and the PWR key is pressed on the learning remote controller 100, a key decode function will correlate (by way of cross referencing) the pressed key and provide a value of (1) as output, which is then used to retrieve the control code information from memory. Based on the value (1), the control code address corresponding to the pressed PWR key is calculated as follows: 0x1000+0x64*(1−1)=0x1000.

For example, when the DVD/VCR device mode has been selected on the learning remote controller 100 and the PLAY key is pressed on the learning remote controller 100, the key decode function will correlate (by way of cross referencing) the pressed key and provide a value of (2) as output, which is then used to retrieve the control code information from memory. Based on the value (1), the control code address corresponding to the pressed PLAY key is calculated as follows: 0x1000+0x64*(2−1)=0x1064.

The process described above for retrieval of control codes with respect to the PWR key and the PLAY key in the DVD/VCR device mode also applies to the remaining keys and associated stored control codes in the DVD/VCR device mode.

The process described above for retrieval of control codes with respect to the DVD/VCR device mode also applies to the TV device mode, the AUDIO/RCVR device mode, and the STB/CBL device mode.

In the process described above for retrieval of control codes, the address of each of the control codes is fixed. Where a particular key is pressed the software control directly goes to the address and starts processing the control code.

Another way of mapping is by way of associating each of the learned functions with a device tag (TV, DVD/VCR, AUDIO/RCVR and STB/CBL) and a key tag during storage.

FIG. 9 is a diagram illustrating respective device tags associated with each device and respective key tags associated with keys in the device maps 404-410 for the respective devices. As shown in FIG. 9, the device tag associated with the TV is 0x01; the device tag associated with the DVD/VCR is 0x02; the device tag associated with the AUDIO/RCVR is 0x03; and the device tag associated with STB/CBL is 0x04. As shown in FIG. 9, a key tag 0x01 is associated with the first key in each of the device maps 404-410; a key tag 0x02 is associated with the second key in each of the device maps, a key tag 0x03 is associated with the third key in each of the device maps, and so on through a key tag 0x1A associated with the twenty-sixth key in each of the device maps. Of course, the device map 400 having twenty-six keys is only an example, and the number of keys in the device map may be more or less than twenty-six. The device tags shown in FIG. 9 are determined by the mode in which the learning remote controller 100 is set. The key tags shown in FIG. 9 correspond to the key count by the key counter.

Figure 10:
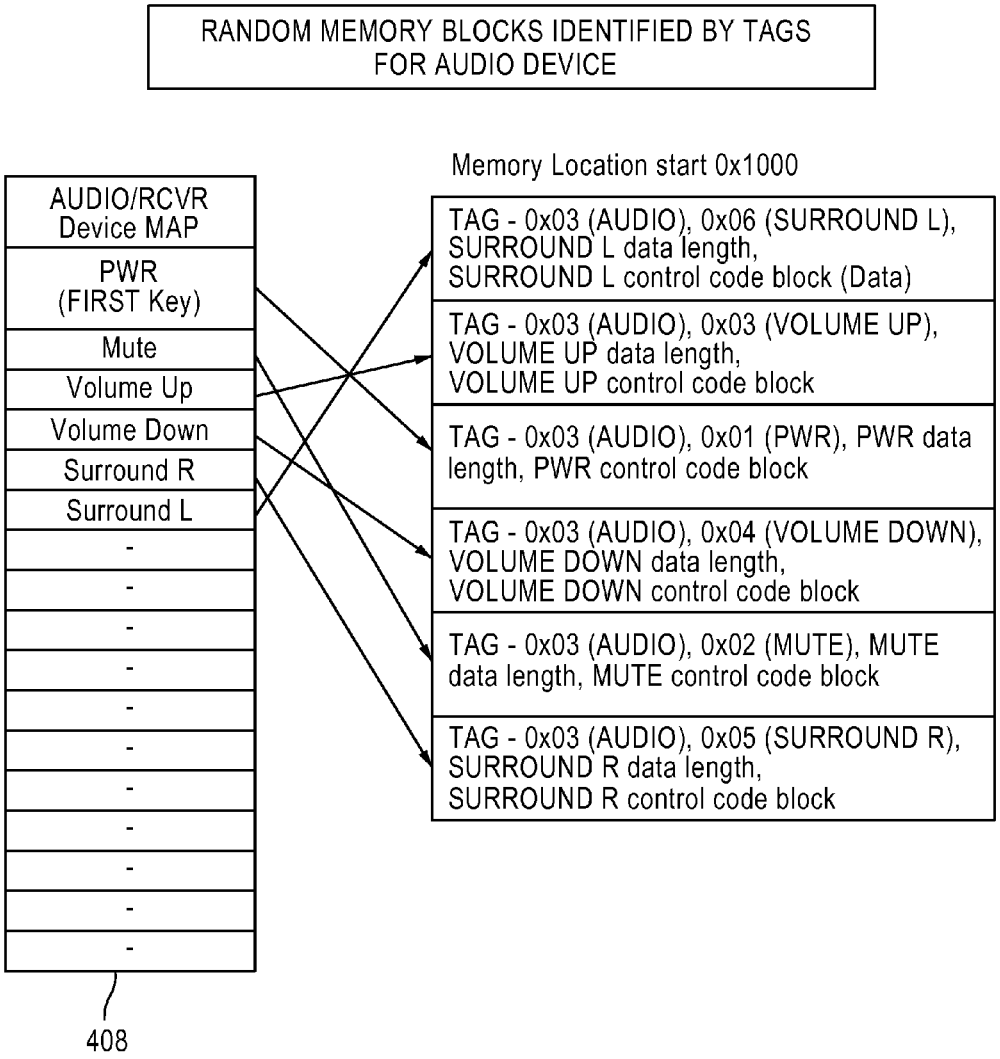
FIG. 10 is a diagram illustrating an example where the memory in which the control codes received from the source remote controller are stored consists of random memory blocks identified by device tags and key tags, and the random memory blocks respectively correspond to the AUDIO/RCVR device map.

FIG. 10 is a diagram illustrating an example where the memory in which the control codes received from the source remote controller 50 are stored consists of random memory blocks identified by the device tags and key tags, and the random memory blocks respectively correspond to the AUDIO/RCVR device map 408. Control codes received from the source remote controller 50 are stored in the random memory blocks.

Figure 11:
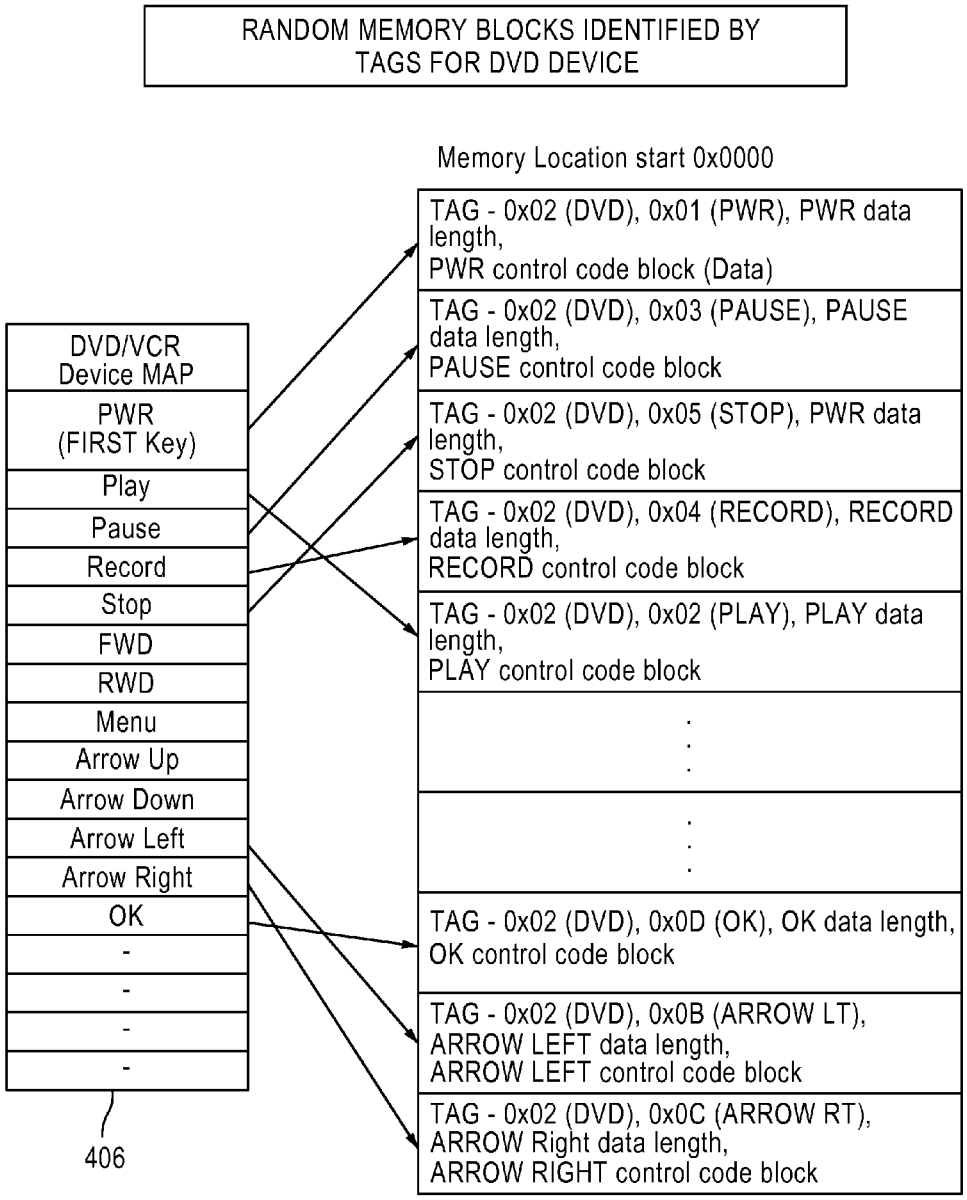
FIG. 11 is a diagram illustrating an example where the memory in which the control codes received from the source remote controller are stored consists of random memory blocks identified by the device tags and key tags, and the random memory blocks respectively correspond to the DVD/VCR device map.

FIG. 11 is a diagram illustrating an example where the memory in which the control codes received from the source remote controller 50 are stored consists of random memory blocks identified by the device tags and key tags, and the random memory blocks respectively correspond to the DVD/VCR device map 406. Control codes received from the source remote controller 50 are stored in the random memory blocks.

By way of example, the storage of the control code received from the source remote controller 50 corresponding to the PWR key in a random block of memory identified by the device tag and key tag, and corresponding to the DVD/VCR device map 406 is performed in the following manner.

DVD/VCR "PWR" key association:

Memory start address, for example, 0x1000

Device tag 0x02 (the device tag corresponds to the mode of the learning remote controller)

Key tag 0x01 (the key tag corresponds to the key counter value)

Actual control code data size, for example, 100 bytes

Control Code Data

Start address: 0x1000+0x64*(1−1)=0x1000

The PWR control code received from the source remote controller 50 is stored in the address range 0x1000 to 0x1063 (0x1000+(0x64−1)). The device tag, key tag and the control code data length information precede the actual control code.

By way of example, the storage of the control code received from the source remote controller 50 corresponding to the PLAY key in a random block of memory identified by the device tag and key tag, and corresponding to the DVD/VCR device map 406 is performed in the following manner.

DVD/VCR "PLAY" key association:

Memory start address=0x1000+PWR Key data length (0x64)=0x1064

Device tag 0x02 (the device tag corresponds to the mode of the learning remote controller)

Key tag 0x02 (the key tag corresponds to the key counter value)

Actual control code data size, for example, 100 bytes

Control Code Data

The PLAY control code received from the source remote controller 50 is stored within the address range 0x1064 to 0x10C8 (0x1064+0x64). The device tag, key tag and the control code data length information precede the actual control code. The remaining control codes received from the source remote controller 50 corresponding to the DVD/VCR device map 406 are stored similarly.

An example of a process of retrieval of the control codes stored in the manner described above with respect to FIGS. 10 and 11 will be described below. The process of retrieval of the control codes is performed by the processor 102.

When a key on the learning remote controller 100 is pressed, the key decode function will correlate (by way of cross referencing) the pressed key and provide a value of (x) as output, which is then used to retrieve the control code information from memory.

The software control jumps to address, for example, 0x1000, and retrieves the first few bytes containing the information about device tag, key tag. If the remote mode and key pressed matches with the device tag and key tag, the remaining of the control code information is read and processed for re-transmission. Otherwise, add the control code data length to the current address pointer to jump the next set of control code information and repeat the comparison until the remote mode and key pressed matches with the device tag and key tag stored in the memory. In case of no match, there will be no transmission. It will be recognized that in this method, the address of each of the control codes may be dynamic. Where a particular key is pressed the software derives the address using the initial address, device tag, key tag and the control code data length information by shifting through the memory for a match of remote mode and key pressed.

FIG. 12 is a diagram illustrating an example of a learning process for the learning remote controller 100 when learning the functions of a TV source remote controller where certain keys and their associated functions are not available on the TV source remote controller. In the example shown in FIG. 7, the TV source remote controller does not include keys corresponding to the Arrow up key, the Arrow down key, the Arrow left key, the Arrow right key, OK key and the Back key.

As shown in FIG. 12, during the learning process, the TV device map 404 is selected, and a key press sequence 402 on the source TV remote controller is performed according to the TV device map 404. The first key pressed by the operator on the TV source remote controller in the sequence is the PWR key, and the learning process maps the control code or function corresponding to the PWR key of the TV source remote controller to the PWR key of the learning remote controller 100, as shown in column 700 in FIG. 12. The second key pressed on the TV source remote controller is the MUTE key, and the learning process maps the control code or function corresponding to the MUTE key of the TV source remote controller to the MUTE key of the learning remote controller 100. The third key pressed on the TV source remote controller is the VOLUME UP key, and the learning process maps the control code or function corresponding to the VOLUME UP key of the TV source remote controller to the VOLUME UP key of the learning remote controller 100, and so on until the operator reaches the ARROW UP key in the key press sequence (the 7th key pressed in the sequence).

However, because there is no ARROW UP key on the TV source remote controller, the operator will press the PWR key on the TV source remote controller when the seventh key in the key press sequence is to be pressed. By pressing the PWR key, the learning process will map a control code indicating a "hole" or no function to the ARROW UP key of the learning remote controller 100. Similarly, because there are no keys on the TV source remote controller corresponding to the ARROW DOWN key, the ARROW LEFT key, the ARROW RIGHT key, the OK key and the BACK key, the operator will press the PWR key on the source remote controller when the 8th, 9th, 10th, 11th and 24th keys, respectively, in the key press sequence are to be pressed. By pressing the PWR key, the learning process will map a control code indicating a "hole" or no function to the ARROW DOWN key, the ARROW LEFT key, the ARROW RIGHT key, the OK key and the BACK key, respectively, of the learning remote controller 100, as shown in column 700 in FIG. 12.

FIG. 13 is a diagram illustrating an example of a learning process for the learning remote controller 100 when learning the functions of a DVD source remote controller where certain keys and their associated functions are not available on the DVD source remote controller. In the example shown in FIG. 13, the DVD source remote controller does not include the key corresponding to the RECORD key.

During the learning process shown in FIG. 13, the DVD/VCR device map 406 shown in FIG. 4 is selected. As shown in FIG. 13, during the learning process, with the DVD/VCR device map 406 selected, and a key press sequence 402 on the source DVD remote controller is performed according to the DVD/VCR device map 406. The first key pressed by the operator on the DVD source remote controller in the sequence is the PWR key, and the learning process maps the control code or function corresponding to the PWR key of the DVD source remote controller to the PWR key of the learning remote controller 100, as shown in column 800 in FIG. 13. The second key pressed on the DVD source remote controller is the PLAY key, and the learning process maps the control code or function corresponding to the PLAY key of the DVD source remote controller to the PLAY KEY of the learning remote controller 100. The third key pressed on the DVD source remote controller is the PAUSE key, and the learning process maps the control code or function corresponding to the PAUSE key of the TV source remote controller to the PAUSE key of the learning remote controller 100.

However, because there is no RECORD key on the DVD source remote controller, the operator will press the PWR key on the DVD source remote controller when the fourth key in the key press sequence is to be pressed. By pressing the PWR key, the learning process will map a control code indicating a "hole" or no function to the RECORD key of the learning remote controller 100. After the process completes mapping of the thirteenth key in the key press sequence (i.e., the OK key), the process is exited.

After the learned functions are stored, valid learned functions can be reproduced by the learning remote controller 50 in a conventional manner when the user presses the appropriate key or button on the learning remote controller 50 in the selected device category (TV, DVD, AUDIO, STB/CBL, etc.).

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention, which is to be determined by the following claims. For example, the "hole" key can be used to learn special functions, if necessary.

What is claimed is:

1. A learning remote controller having a learning function for learning functions received from a source controller, the learning remote controller comprising:

a memory; and a processor that executes a program stored in the memory, the program controlling operation of the processor to:

place the learning remote controller in a learning mode;

select and retrieve a device map corresponding to a source remote controller having functions that are to be learned by the learning remote controller, the device map establishing a correspondence between a key pressed on the source remote controller and a key on the learning remote controller to which a function received from the source remote controller is to be mapped;

receive a code corresponding to a function from a source remote controller;

determine whether the received code corresponds to a first signal received from the source remote controller;

store the received code as a first stored code in response to determining that the received code corresponds to the first signal received from the source remote controller;

compare the received code with the first stored code in response to determining that the received code does not correspond to the first signal received from the source remote controller;

insert a code corresponding to no function in a sequence of learned codes in response to the comparison of the received code and the first code stored being a match; and mapping the received code to a corresponding key on the learning remote controller in response to the comparison of the received code and the first code stored not being a match.

2. A method of a learning remote controller learning functions received from a source controller, comprising:

placing the learning remote controller in a learning mode;

selecting and retrieving a device map corresponding to a source remote controller having functions that are to be learned by the learning remote controller, the device map establishing a correspondence between a key pressed on the source remote controller and a key on the learning remote controller to which a function received from the source remote controller is to be mapped;

receiving a code corresponding to a function from a source remote controller;

determining whether the received code corresponds to a first signal received from the source remote controller;

storing the received code as a first stored code in response to determining that the received code corresponds to the first signal received from the source remote controller;

comparing the received code with the first stored code in response to determining that the received code does not correspond to the first signal received from the source remote controller;

inserting a code corresponding to no function in a sequence of learned codes in response to the comparison of the received code and the first code stored being a match; and mapping the received code to a corresponding key on the learning remote controller in response to the comparison of the received code and the first code stored not being a match.

3. A computer-readable medium encoded with instructions for causing a processor to perform a method of a learning remote controller learning functions received from a source controller, comprising:

placing the learning remote controller in a learning mode;

retrieving a device map corresponding to a source remote controller having functions that are to be learned by the learning remote controller, the device map establishing a correspondence between a key pressed on the source remote controller and a key on the learning remote controller to which a function received from the source remote controller is to be mapped;

receiving a code corresponding to a function from a source remote controller;

determining whether the received code corresponds to a first signal received from the source remote controller;

storing the received code as a first stored code in response to determining that the received code corresponds to the first signal received from the source remote controller;

comparing the received code with the first stored code in response to determining that the received code does not correspond to the first signal received from the source remote controller;

inserting a code corresponding to no function in a sequence of learned codes in response to the comparison of the received code and the first code stored being a match; and mapping the received code to a corresponding key on the learning remote controller in response to the comparison of the received code and the first code stored not being a match.

* * * * *